US006920705B2

(12) United States Patent
Lucas et al.

(10) Patent No.: US 6,920,705 B2
(45) Date of Patent: Jul. 26, 2005

(54) SHOE CARTRIDGE CUSHIONING SYSTEM

(75) Inventors: Robert J. Lucas, Erlangen (DE); Allen W. Van Noy, Weisendorf (DE); Stephen M. Vincent, Herzogenaurach (DE); Christian Tresser, HeBdorf (DE)

(73) Assignee: adidas International Marketing B.V. (NL)

( * ) Notice: Subject to any disclaimer, the term of this patent is extended or adjusted under 35 U.S.C. 154(b) by 0 days.

(21) Appl. No.: 10/391,488

(22) Filed: Mar. 18, 2003

(65) Prior Publication Data

US 2003/0208929 A1 Nov. 13, 2003

(30) Foreign Application Priority Data

Mar. 22, 2002 (DE) ..... 102 12 862

(51) Int. Cl.[7] ..... A43B 13/18
(52) U.S. Cl. ..... 36/25 R; 36/28; 36/142
(58) Field of Search ..... 36/25 R, 28, 142, 36/143, 144, 31

(56) References Cited

U.S. PATENT DOCUMENTS

| | | | |
|---|---|---|---|
| 4,139,187 | A | 2/1979 | Hanusa |
| 4,314,413 | A | 2/1982 | Dassler |
| 4,354,318 | A | 10/1982 | Frederick et al. |
| 4,391,048 | A | 7/1983 | Lutz |
| 4,524,529 | A | 6/1985 | Schaefer |
| 4,551,930 | A | 11/1985 | Graham et al. |
| 4,566,206 | A | 1/1986 | Weber |
| 4,592,153 | A | 6/1986 | Jacinto |
| 4,616,431 | A | 10/1986 | Dassler |
| 4,654,983 | A | 4/1987 | Graham et al. |
| 4,771,554 | A | 9/1988 | Hannemann |
| 4,843,741 | A | 7/1989 | Yung-Mao |
| 4,874,640 | A | 10/1989 | Donzis |
| 4,876,053 | A | 10/1989 | Norton et al. |
| 4,881,329 | A | 11/1989 | Crowley |
| 5,052,130 | A | 10/1991 | Barry et al. |
| 5,060,401 | A | 10/1991 | Whatley |
| 5,070,629 | A | 12/1991 | Graham et al. |
| 5,191,727 | A | 3/1993 | Barry et al. |
| 5,279,051 | A | 1/1994 | Whatley |
| D344,174 | S | 2/1994 | Kilgore |
| 5,343,639 | A | 9/1994 | Kilgore et al. |
| 5,353,523 | A | 10/1994 | Kilgore et al. |
| 5,353,526 | A | 10/1994 | Foley et al. |

(Continued)

FOREIGN PATENT DOCUMENTS

| | | |
|---|---|---|
| DE | G 92 10 113.5 | 11/1992 |
| EP | 0192820 | 9/1986 |
| EP | 0299669 | 1/1989 |
| EP | 0 359 421 | 3/1990 |
| EP | 0714246 | 6/1996 |
| EP | 0 714 611 | 6/1996 |
| EP | 0 815 757 | 1/1998 |
| EP | 0 877 177 | 11/1998 |
| EP | 1118280 | 7/2001 |
| WO | WO 95/20333 | 8/1995 |
| WO | WO 97/13422 | 4/1997 |
| WO | WO 01/17384 | 3/2001 |

*Primary Examiner*—M. D. Patterson
(74) *Attorney, Agent, or Firm*—Goodwin Procter LLP

(57) ABSTRACT

The present invention relates to a shoe sole, in particular for a sports shoe, where the sole includes a cartridge cushioning system that includes a load distribution plate and deformation elements disposed in a forefoot region of the sole to provide support and/or cushioning to the forefoot. The shoe sole may include a second cartridge cushioning system that includes a second load deformation plate and functional elements disposed in a heel region of the sole to guide the foot into a neutral position after the first ground contact.

34 Claims, 9 Drawing Sheets

U.S. PATENT DOCUMENTS 5,367,792 A 11/1994 Richard et al.
5,381,608 A 1/1995 Claveria
D355,755 S 2/1995 Kilgore
5,461,800 A 10/1995 Luthi et al.
5,488,786 A 2/1996 Ratay
5,493,791 A * 2/1996 Kramer ..... 36/28
5,544,431 A 8/1996 Dixon
5,560,126 A 10/1996 Meschan et al.
5,577,334 A 11/1996 Park
5,615,497 A 4/1997 Meschan
5,644,857 A 7/1997 Ouellette et al.
5,678,327 A 10/1997 Halberstadt
5,718,063 A 2/1998 Yamashita et al.
5,743,028 A 4/1998 Lombardino
5,761,831 A 6/1998 Cho
5,782,014 A 7/1998 Peterson
5,806,209 A 9/1998 Crowley et al.
5,806,210 A 9/1998 Meschan
5,822,886 A 10/1998 Luthi et al.
5,826,352 A 10/1998 Meschan et al.
5,918,384 A 7/1999 Meschan
5,926,974 A * 7/1999 Friton ..... 36/28
5,937,544 A 8/1999 Russell
5,937,545 A 8/1999 Dyer et al.
5,970,628 A 10/1999 Meschan
5,983,529 A 11/1999 Serna
5,987,781 A 11/1999 Pavesi et al.
5,996,253 A 12/1999 Spector
5,996,260 A 12/1999 MacNeill
6,023,859 A 2/2000 Burke et al.
6,029,374 A 2/2000 Herr et al.
6,050,002 A 4/2000 Meschan
6,055,746 A 5/2000 Lyden et al.
6,115,944 A 9/2000 Lain
6,119,373 A * 9/2000 Gebhard et al. ..... 36/114
6,127,010 A 10/2000 Rudy
6,195,916 B1 3/2001 Meschan
6,199,302 B1 3/2001 Kayano
6,237,251 B1 5/2001 Litchfield et al.
6,324,772 B1 12/2001 Meschan
6,354,020 B1 3/2002 Kimball et al.
6,487,796 B1 12/2002 Avar et al.
6,568,102 B1 5/2003 Healy et al.
6,604,300 B2 8/2003 Meschan
6,662,471 B2 12/2003 Meschan
6,722,058 B2 * 4/2004 Lucas et al. ..... 36/28
6,751,891 B2 * 6/2004 Lombardino ..... 36/28
2001/0049888 A1 * 12/2001 Krafsur et al. ..... 36/27
2002/0078601 A1 6/2002 Alfond et al.
2002/0129516 A1 9/2002 Lucas et al.

* cited by examiner

SHOE CARTRIDGE CUSHIONING SYSTEM

CROSS-REFERENCE TO RELATED APPLICATIONS

This application incorporates by reference, and claims priority to and the benefit of, German patent application serial number 102 12 862.6, titled "Shoe Sole," filed on Mar. 22, 2002. This application also relates to U.S. patent application Ser. No. 10/099,859, which is hereby incorporated herein by reference in its entirety.

TECHNICAL FIELD

The present invention relates to a cushioning system for a shoe using foam components having different shapes and densities.

BACKGROUND

When shoes, in particular sports shoes, are manufactured, two objectives are to provide a good grip on the ground and to sufficiently cushion the ground reaction forces arising during the step cycle, in order to reduce strain on the muscles and the bones. In traditional shoe manufacturing, the first objective is addressed by the outsole: whereas, for cushioning, a midsole is typically arranged above the outsole. In shoes subjected to greater mechanical loads, the midsole is typically manufactured from continuously foamed ethylene vinyl acetate (EVA).

Detailed research of the biomechanics of a foot during running has shown, however, that a homogeneously shaped midsole is not well suited for the complex processes occurring during the step cycle. The course of motion from ground contact with the heel until push-off with the toe part is a three-dimensional process including a multitude of complex rotating movements of the foot from the lateral side to the medial side and back.

In the past, to selectively influence this course of motion, different support elements have been integrated into the foamed midsole with different material properties that, for example, selectively avoid supination or excessive pronation of the wearer of the shoe. This applies in particular to the forefoot part of the sole, which determines the rolling-off and the push-off properties, and also to the heel part of the sole, which determines the reaction of the shoe during initial ground contact.

Although some progress has been made in the biomechanical control of the step cycle, these developments have a series of disadvantages. For example, the addition of specific support elements to the foamed midsole substantially increases the weight of the shoe, which becomes particularly apparent and disadvantageous with running shoes. Further, the integration of the support elements substantially increases the production costs of the sole, since each of these elements must be securely connected to the surrounding midsole by, for example, cementing, fusing, etc. during manufacture of the shoe.

The described approach of the prior art hinders an easy and cost-efficient modification of the biomechanical properties of a midsole, since each change of the support elements, either with respect to their material or their shape, requires a complete redesign of the midsole. It is not possible to quickly adapt the shoe to new results of biomechanical research or to the changing requirements of a new kind of sport activity.

It is, therefore, an object of the present invention to provide a shoe sole that can be adapted to provide increased support for an arch region of a foot and a high degree of flexibility in a forefoot region, either for cushioning or elastic energy storage.

SUMMARY OF THE INVENTION

Generally, the invention relates to a cartridge cushioning system that includes a load distribution plate and functional elements. In accordance with the invention, the load distribution plate serves as a support for the functional elements of the shoe sole, for example, lateral and medial deformation elements. The load distribution plate transmits and distributes the response of each element to external loads over the forefoot region of the foot. Accordingly, the number, the arrangement, and the specific material properties of the elements contribute to selectively influence the course of motion of a wearer's foot, for example during rolling-off and push-off, to avoid supination or excessive pronation. As such, the independent deformation elements adapt exactly to the deformation needs of a specific area of the wearer's foot.

Because the load distribution plate encases the functional elements starting from an aft end of a forefoot region, the three-dimensional shape of the plate provides increased support for the arch region of the foot and a high degree of flexibility in the forefoot region, either for cushioning or elastic energy storage. If it turns out that different deformation elements are more suitable to meet the present or changed requirements of the sole, the existing deformation elements can easily be replaced without having to make any other modification in the manufacturing process of the sole. Moreover, the overall weight of the sole may be reduced considerably by constructing the forefoot portion in accordance with the invention, with separately arranged forefoot elements instead of the continuously foamed material.

In one aspect, the invention relates to a sole for an article of footwear. The sole includes a first load distribution plate disposed in a forefoot region of the sole, a lateral deformation element, and a medial deformation element. The first load distribution plate extends from an aft end of the forefoot region to encase at least partially at least one of the lateral deformation element and the medial deformation element.

In another aspect, the invention relates to an article of footwear comprising an upper and a sole. The sole includes a first load distribution plate disposed in a forefoot region of the sole, a lateral deformation element, and a medial deformation element. The first load distribution plate extends from an aft end of the forefoot region to encase at least partially at least one of the lateral deformation element and the medial deformation element.

In various embodiments of the foregoing aspects, the lateral deformation element and the medial deformation element are spaced apart from each other to independently deform in response to a load on the sole, which is not possible where the elements are integrated into a surrounding EVA foam. The first load distribution plate has a generally recumbent U-shaped cross-sectional profile, wherein a closed end of the first load distribution plate is oriented towards the aft end of the forefoot region of the sole. This shape leads to increased structural stability of the sole, since the deformation elements are encompassed by the load distribution plate from behind and from below. The first load distribution plate may further include a lateral lower side and a medial lower side, wherein each lower side can be independently deflected. In one embodiment, the lateral lower side and the medial lower side are separated from each other by, for example, a cut section or gap. As such, the response properties of the sole on the medial side can be independently adjusted from the response properties on the lateral side of the forefoot region. In one embodiment, the first load distribution plate includes an upper side extending further towards a front portion of the sole than at least one of the lateral lower side and the medial lower side.

In still other embodiments, the lateral deformation element has a lateral rear deformation element and a lateral front deformation element and the medial deformation element has a medial rear deformation element and a medial front deformation element. In one embodiment, the lateral rear deformation element, the lateral front deformation element, the medial rear deformation element, and the medial front deformation element are spaced apart from each other. The separate deformation elements are sequentially loaded during rolling-off and pushing-off with the foot. Their respective material properties, in particular their compressibility, selectively independently influence each part of this process, on the lateral side as well as on the medial side. The sole may further include a toe-deformation element disposed in a forward portion of the forefoot region and spaced apart from the lateral front deformation element and the medial front deformation element. The toe-deformation element may extend beyond a forward edge of the first load distribution plate and may be more elastic than at least one other deformation element.

In other embodiments, the lateral rear deformation element, the lateral front deformation element, the medial rear deformation element, the medial front deformation element and the toe-deformation element are substantially uniformly spaced apart, and the load distribution plate includes at least one ridge disposed between adjacent deformation elements. In addition, the rear deformation elements may have a different hardness than the front deformation elements. The elasticity of the deformation elements may vary and at least one of the lateral deformation elements may have a different hardness than at least one of the medial deformation elements.

Additionally, the sole may include a second load distribution plate disposed in a heel region of the sole, at least one cushioning element disposed proximate the second load distribution plate, and at least one guidance element disposed proximate the second load distribution plate. The at least one cushioning element is configured and located to determine a cushioning property of the sole during a first ground contact with the heel region. The at least one guidance element is configured and located to bring a wearer's foot toward a neutral position after the first ground contact. The cushioning element protects the joints and muscles against the ground reaction forces arising during the first ground contact, while the material properties of the guidance element assure that even immediately after ground contact, pronation control occurs, bringing the foot into an intermediate position that is correct for this stage of the step cycle. The second load distribution plate in the heel region assures uniform force distribution on the heel and assures that the cushioning and guiding effect of the elements is not restricted to single parts of the heel, but evenly transmitted to the complete heel region. Thus, the foot is optimally prepared for the subsequent rolling-off phase of the forefoot region. In one embodiment, the sole also includes a stability element disposed proximate the second load distribution plate, the stability element configured and located to control pronation during transition to a rolling-off phase of a step cycle.

In various embodiments, the at least one guidance element includes a lateral guidance element and a medial guidance element. The combined effect of these two elements, during ground contact with the shoe sole, enables the controlled transition of the center of mass from the lateral rear side to the center of the heel. The cushioning element, the lateral guidance element, the medial guidance element, and the stability element each may be disposed generally within quadrants of the heel region. In one embodiment, the cushioning element is generally located in a lateral rear quadrant, the lateral guidance element is generally located in a lateral forward quadrant, the medial guidance element is generally located in a medial rear quadrant, and the stability element is generally located in a medial forward quadrant, and at least two of the cushioning element, the lateral guidance element, the medial guidance element, and the stability element are spaced apart. This arrangement of the functional elements advantageously provides complete "pronation control" from the first ground contact until the transition to the rolling-off phase. After the cushioning compression of the cushioning element during the first ground contact, the diagonally arranged guidance elements guide the load of the center of gravity to the center of the heel. The stability element arranged in the medial front part assures that the center of gravity does not excessively shift to the medial side in the course of a further turning of the foot.

Furthermore, the sole may include at least one reinforcing element disposed between at least one of the cushioning element and the lateral guidance element, the lateral guidance element and the stability element, the stability element and the medial guidance element, the medial guidance element and the cushioning element, the cushioning element and the stability element, and the lateral guidance element and the medial guidance element. In one embodiment, at least one of the lateral guidance element and the medial guidance element has a greater hardness than the cushioning element. Also, the hardness of at least one of the lateral guidance element, the medial guidance element, and the stability element may vary.

In yet further embodiments, the stability element extends beyond an edge of the second load distribution plate. The second load distribution plate has a generally recumbent U-shaped cross-sectional profile and receives in an interior region thereof at least a portion of one of the cushioning element, the lateral guidance element, the medial guidance element, and the stability element. In one embodiment, a closed end of the second load distribution plate is oriented towards the forefoot region of the sole. The sole may further include an outsole at least partially disposed below at least one of the cushioning element, the lateral guidance element, the medial guidance element, and the stability element. The outsole may be configured to allow for independent deformation of at least one of the cushioning element, the lateral guidance element, the medial guidance element, and the stability element. In another embodiment, the first load distribution plate is coupled to the second load distribution plate.

These and other objects, along with advantages and features of the present invention herein disclosed, will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION OF THE INVENTION

Embodiments of the present invention are described below. It is, however, expressly noted that the present invention is not limited to these embodiments, but rather the intention is that variations, modifications, and equivalents that are apparent to the person skilled in the art are also included. In particular, the present invention is not intended to be limited to soles for sports shoes, but rather the present invention can also be used to produce soles for any article of footwear. Further, only a left or right sole and/or shoe is depicted in any given figure; however, it is to be understood that the left and right soles/shoes are typically mirror images of each other and the description applies to both left and right soles/shoes.

Figure 1:
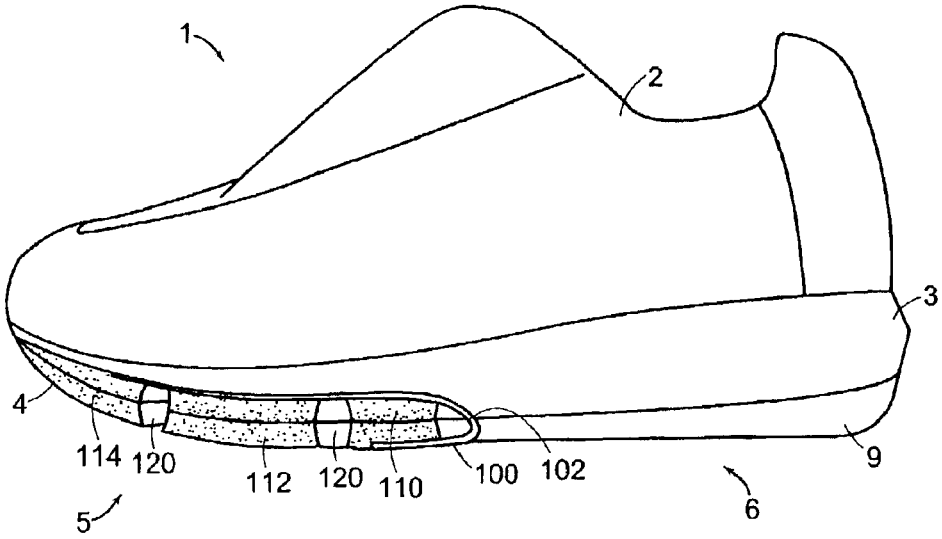
FIG. 1 is a schematic side view of a shoe with one embodiment of a sole in accordance with the invention.
Figure 2:
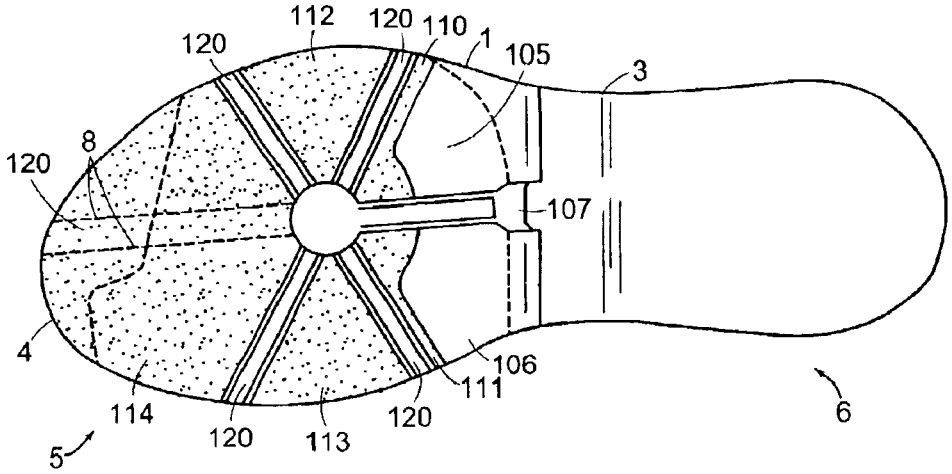
FIG. 2 is a schematic bottom view of the sole of FIG. 1.
Figure 3:
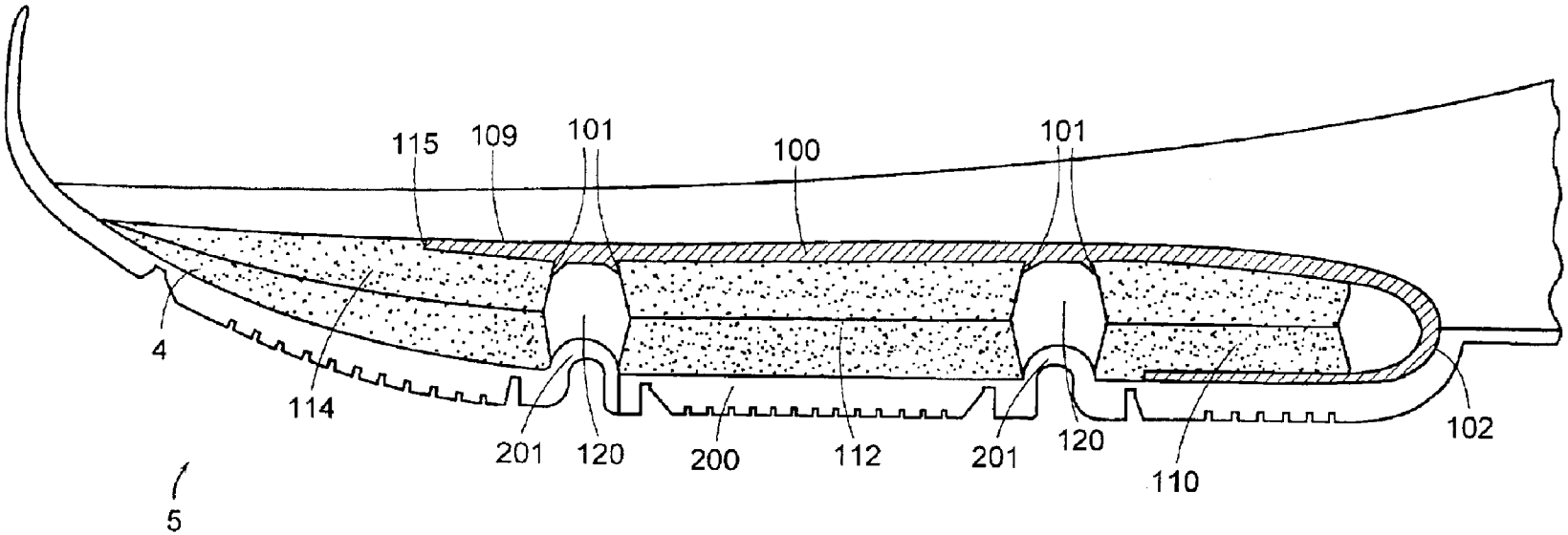
FIG. 3 is a schematic enlarged side view of a forefoot region of the sole of FIG. 1.

FIGS. 1–3 are various views of a shoe 1 including a sole 3 in accordance with the invention. FIG. 1 depicts a lateral side view of the shoe 1, the sole 3 of which incorporates a cartridge cushioning system 4 in accordance with the invention. The system 4 is disposed in a forefoot region 5 of the sole 3 and is arranged below a shoe upper 2 manufactured according to known methods. In the forefoot region 5, which generally encompasses the front half of a foot, several deformation elements 110, 111, 112, 113, 114 are arranged below a load distribution plate 100 having a generally recumbent U-shaped cross-sectional profile and a closed end 102. Alternatively, the load distribution plate 100 can be a single substantially planar piece. The U-shaped load distribution plate 100 provides greater structural stability to the sole 3, because two of the deformation elements 110, 111, 112, 113, 114 are at least partly encompassed on several sides, as best seen in FIGS. 2 and 3. Furthermore, the load distribution plate 100 can provide a greater stiffness in a rear portion of the forefoot region 5 below the arch area of the foot, thereby enhancing support in the arch area.

FIG. 2 is a bottom view of the sole 3 of FIG. 1 depicting one possible distribution of the deformation elements 110, 111, 112, 113, 114 below the load distribution plate 100. Starting from the center of the sole 3, a rear lateral deformation element 110 is arranged next to a rear medial deformation element 111 followed by a front lateral deformation element 112 and a front medial deformation element 113. A toe-deformation element 114 is arranged in a forward portion of the forefoot region 5. As can be seen in FIGS. 1–3, the deformation elements 110, 111, 112, 113, 114 are each disposed below an upper surface of the load distribution plate 100 and spaced apart a predetermined distance 120 from each other. This spacing allows completely independent deformation of each element. The rear lateral deformation element 110 and the rear medial deformation element 111 function primarily as guidance elements, i.e., they maintain the foot in a neutral position between supination and pronation during the foot's transition into the rolling-off phase. The front lateral deformation element 112, the front medial deformation element 113, and in particular the toe-deformation element 114 are increasingly elastic, as described in greater detail hereinbelow.

The distances 120 between the elements 110, 111, 112, 113, 114 are preferably arranged in a star-like pattern; however, other distributions of the elements 110, 111, 112, 113, 114 are also possible, for example with distances 120 running straight from the medial side to the lateral side of the sole 3. In some cases, it is possible that the edges of the deformation elements 110, 111, 112, 113, 114 may contact each other, as long as substantially independent deformation of each single deformation element is assured. The toe-deformation element 114 may also be formed in two parts, as indicated by a dashed line 8 in FIG. 2. Also contemplated are embodiments where only a groove-like recess is arranged between the lateral portion and the medial portion of the toe-deformation element 114, thereby providing separate lateral and medial push-off regions of the forefoot region 5.

The compression characteristics of the deformation elements 110, 111, 112, 113, 114 can be determined by using materials with differing properties and also by varying the size and shape of the elements 110, 111, 112, 113, 114 to selectively influence the rolling-off properties of the shoe. If, for example, the medial front deformation element 113 and/or the medial rear deformation element 111 have a greater hardness compared to the other deformation elements, pronation is opposed. Inversely, if an athlete is more likely to supinate, a lateral front deformation element 112 and/or a lateral rear deformation 110 of a greater hardness could be used to oppose supination. Further, differences in the size, shape, and/or material properties, of the front and rear deformation elements of the lateral and/or the medial side can be provided. In a particular embodiment, EVA elements based on a rubber mixture are used for the deformation elements having, for example, a hardness of 57 Shore Asker C. Other possible materials are discussed in further detail hereinbelow. It is also possible to provide a deformation element 110, 111, 112, 113, 114 with a varying hardness (i.e., a hardness changing along the element's extent), as opposed to a constant hardness. Also, the shape of the elements 110, 111, 112, 113, 114 may influence the deformation characteristics. For example, a concave recess or groove provides a different characteristic (softer) than a convex projection (harder).

For the toe-deformation element 114, the use of a highly elastic material is suitable. The highly elastic material deforms substantially without energy loss and thereby facilitates the push-off from the ground. At the beginning of the rolling-off phase, this element is at first "loaded" due to the increasing weight. Potential energy is stored by the elastic deformation of the element. At the end of the rolling-off phase, directly during push-off, the stored energy is released and transmitted as kinetic energy to the foot of the wearer to support the course of motion.

FIG. 3 is an enlarged view of the forefoot region 5 of the sole 3. FIG. 3 depicts an example of how the elements of the invention can be integrated into the complete sole 3. Apart from the already discussed deformation elements 110, 111, 112, 113, 114 and the load distribution plate 100, a front outsole 200 can be included. The front outsole 200 can terminate on the lower side of the forefoot region 5. The profile of the outsole 200 will vary to suit a particular application, for example, the intended field of use of the shoe 1.

In order not to interfere with the independent deformation of the deformation elements 110, 111, 112, 113, 114, the distances 120 are covered by bellows-like structures 201 in the outsole 200. If, for example, the front medial deformation element 113 is further deformed than the rear medial deformation element 111, the distance 120 to be covered by the outsole 200 is greater. This change in distance, however, can be easily compensated by the bellows-like structure 201 of the outsole 200 so that both deformation elements 111, 113 can still react to the arising loads substantially independently relative to each other. The structures 201 also keep dirt and moisture from entering into the distances 120, without impairing the dynamics of the deformation elements 110, 111, 112, 113, 114.

Figure 4:
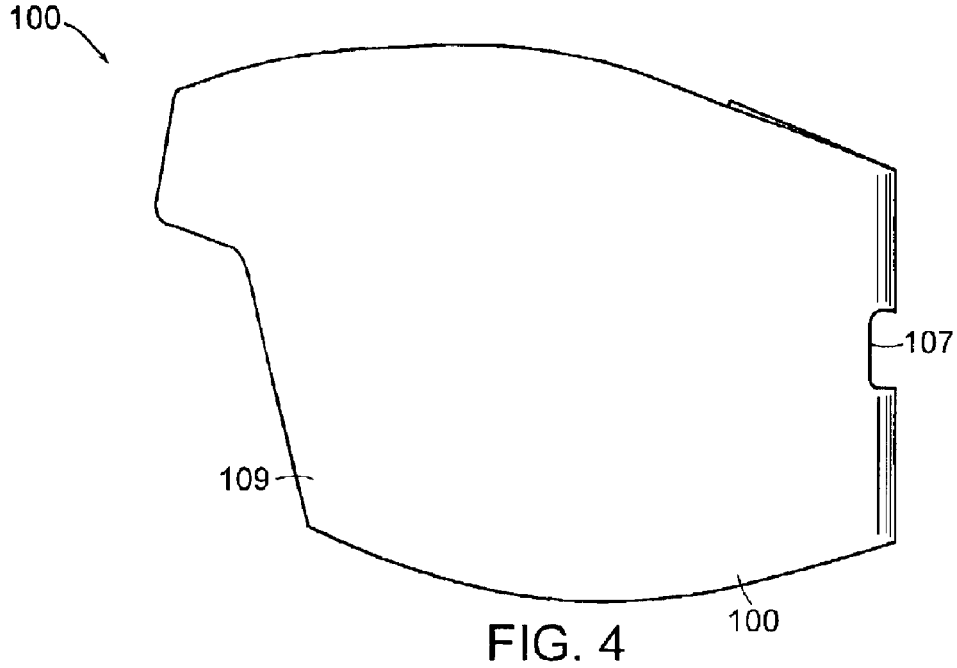
FIG. 4 is a schematic top view of one embodiment of a first load distribution plate in accordance with the invention.
Figure 5:
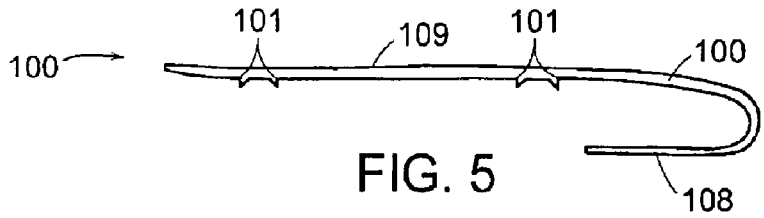
FIG. 5 is a schematic side view of the first load distribution plate of FIG. 4.
Figure 6:
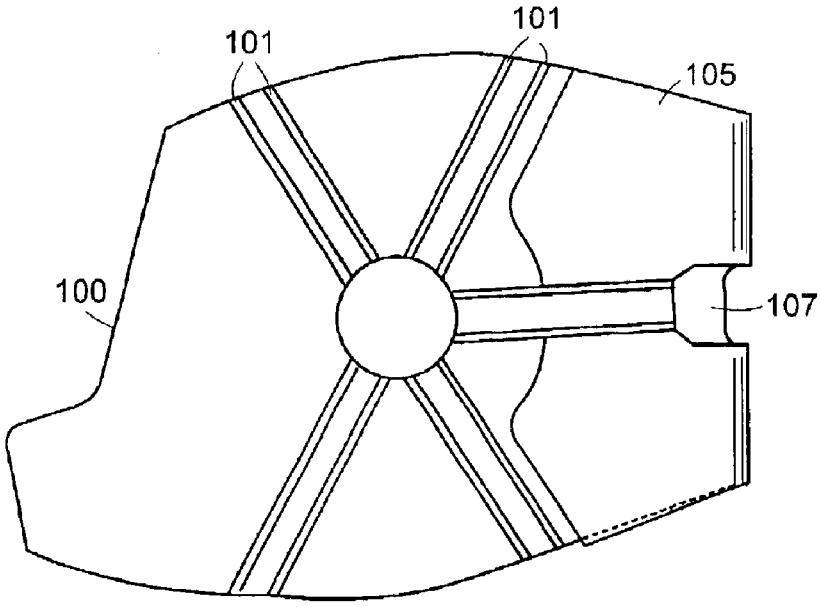
FIG. 6 is a schematic bottom view of the first load distribution plate of FIG. 4.

FIGS. 4–6 show detailed views of one embodiment of the load distribution plate 100. The side view of FIG. 5 and bottom view of FIG. 6 depict a series of relatively small ridges 101 that border each area for receiving the deformation elements 110, 111, 112, 113, 114. The ridges 101 help define the distances 120 between the elements 110, 111, 112, 113, 114 and avoid transverse sliding of the deformation elements 112, 113, 114 that are not encompassed by the U-shaped casing, without having to support each other. Like the distances 120, the ridges 101 are preferably arranged in a star-like pattern; however, the placement of the ridges will vary depending on the configuration and distribution of the elements 110, 111, 112, 113, 114.

Figure 7:
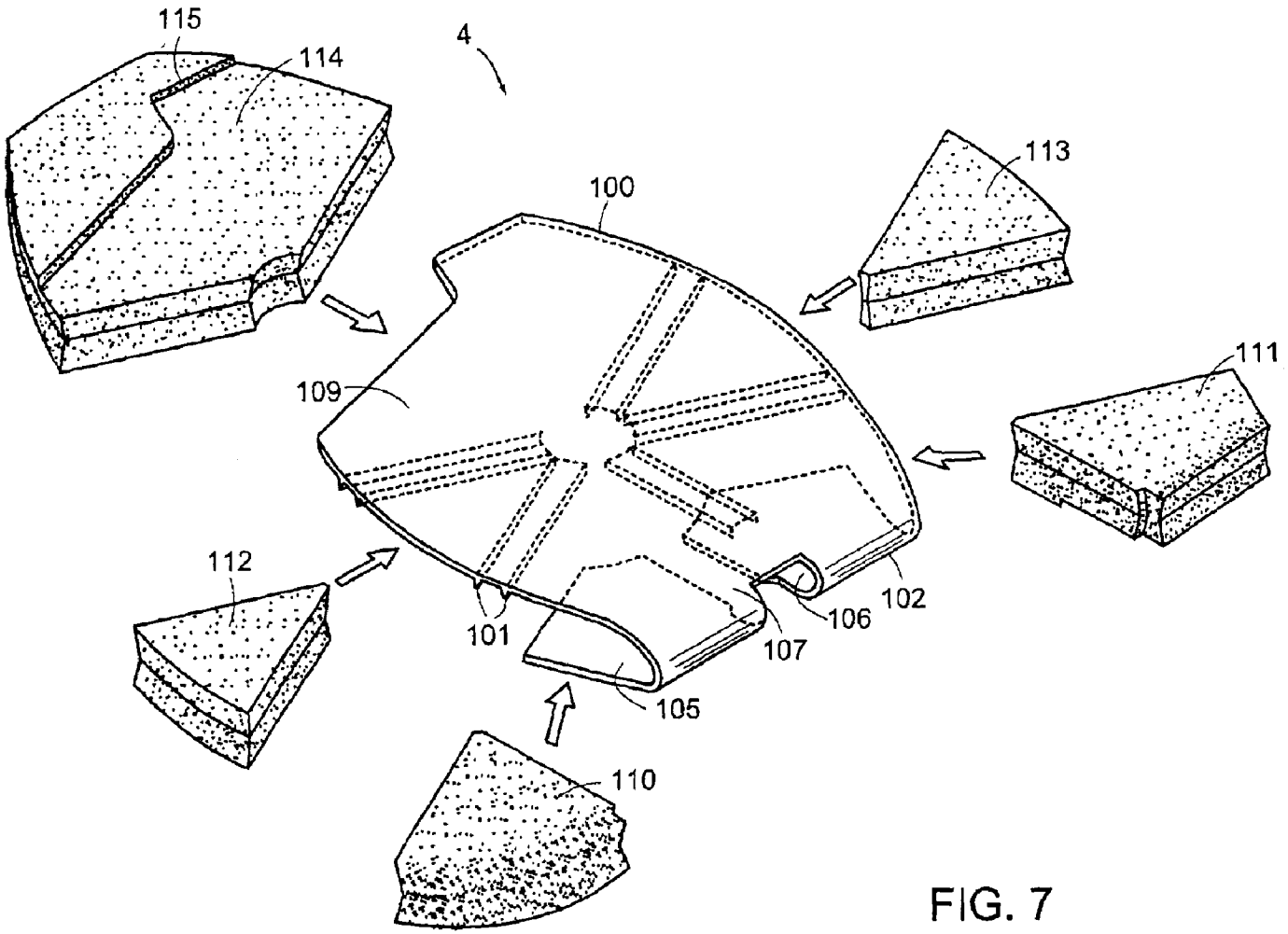
FIG. 7 is a schematic exploded view of an embodiment of a cartridge cushioning system in accordance with the invention.

The toe-deformation element 114 optionally has an edge 115 that provides additional support to an upper side 109 of the load distribution plate 100, as best seen in FIGS. 3 and 7. The assembly of the deformation elements 110, 111, 112, 113, 114 and the load distribution plate 100, as well as the above discussed details, are best seen in FIG. 7. The cartridge cushioning system is advantageously modularized. As such, the characteristics of the sole 3 can be modified without having to change the manufacturing process of the sole 3. For example, elements 110, 111, 112, 113, 114 with different performance characteristics can be interchanged to customize the sole 3. Further, kits of elements can be supplied during manufacturing for quickly producing soles with different properties.

The lower side 108 of the U-shaped portion of the load distribution plate 100 is shorter than its upper side 109, as best seen in FIGS. 5 and 7. In addition, the lower side 108 is divided into two parts, with a lateral lower side 105 and a medial lower side 106 separated by a cut section 107. This allows for separate independent deflection of the medial lower side 106 and the lateral lower side 105 of the load distribution plate 100 and if desired the sole sides can be configured with a different restoring force. This reflects once more the ability of the present invention to independently adjust the properties of the sole 3 on the medial side and on the lateral side of the forefoot region 5.

Figure 8:
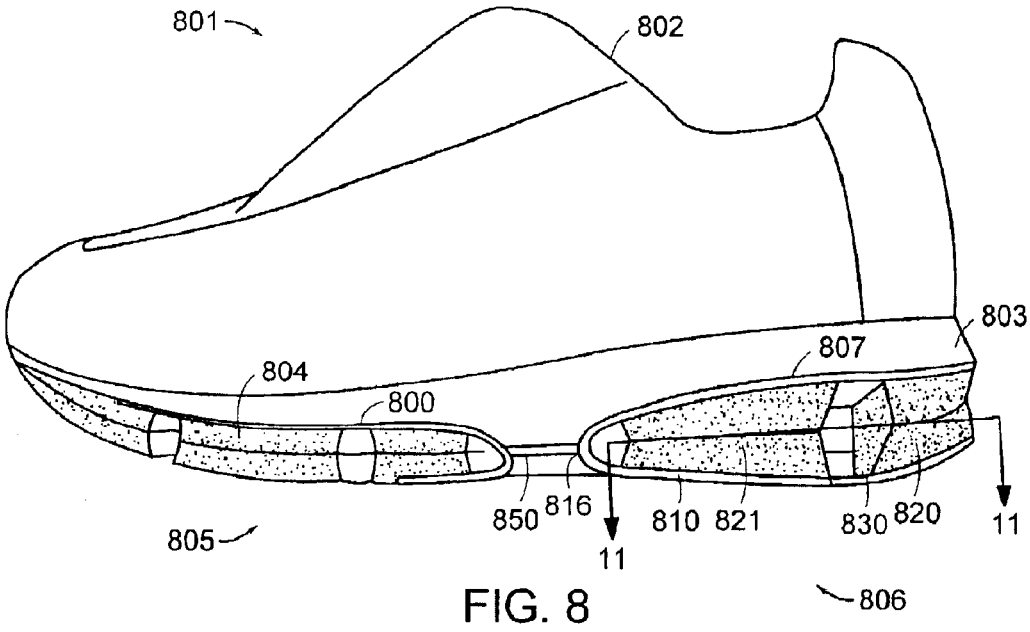
FIG. 8 is a schematic side view of a shoe having a second load distribution plate in a heel region in accordance with an alternative embodiment of a sole.
Figure 9:
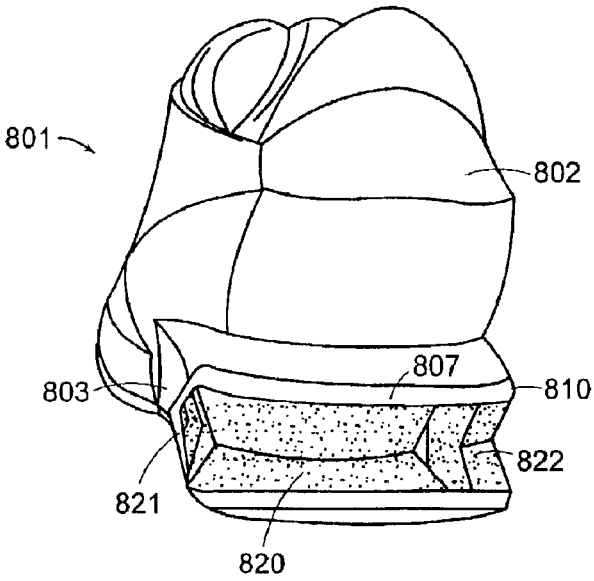
FIG. 9 is a schematic rear view of the shoe of FIG. 8.
Figure 10:
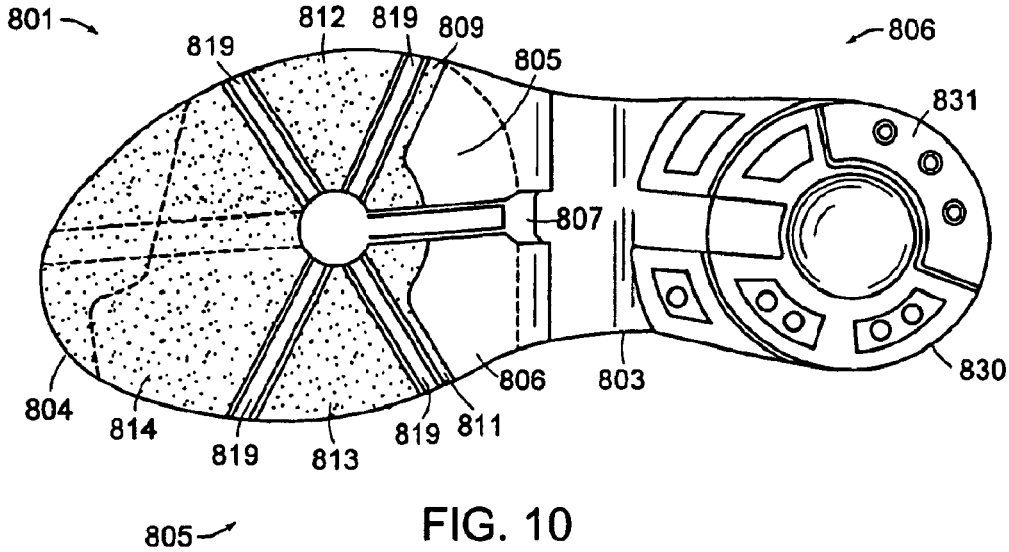
FIG. 10 is a schematic bottom view of the sole of FIG. 8.

FIGS. 8–10 are various views of an alternative embodiment of a shoe 801 including a sole 803 in accordance with the invention. FIG. 8 depicts a lateral side view of the shoe 801 including an upper 802 manufactured according to known methods and the sole 803. The sole 803 includes a first cartridge cushioning system 804 disposed in a forefoot region 805 of the sole. The first cartridge cushioning system 804 is configured generally as previously described with respect to FIGS. 1–7.

The sole 803 also includes a second cartridge cushioning system 807 that includes a second load distribution plate 810 that extends in a heel region 806 of the sole 803. The second load distribution plate 810 is shown having a generally recumbent U-shaped cross-sectional profile having a closed end 816; however, the load distribution plate 10 can be a single substantially planar piece. Several functional elements 820, 821, 822, 823 are arranged proximate the second load distribution plate 810. FIGS. 8 and 9 show a cushioning element 820 disposed in a lateral rear portion of the heel region 806, a first guidance element 821 disposed in a front portion of the heel region 806, and a second guidance element 822 disposed on a medial side of the heel region 806. The second load distribution plate 810 generally circumscribes and receives therein the various functional elements 820, 821, 822, 823; however, in the embodiment where the second load distribution plate 810 is a single planar piece, the functional elements 820, 821, 822, 823 are typically disposed below the second load distribution plate 810. Alternatively, for maximum structural stability, it is possible to combine the first load distribution plate 800 and the second load distribution plate 810 to provide a base structure for the complete sole area. The two plates 800, 810 can be connected directly or coupled by, for example, a torsion element 850.

In the embodiment shown in FIG. 10, the sole 803 includes an optional outsole 830 disposed at least partially below the heel region 806. In the embodiment shown in FIG. 10, the outsole 830 includes a separate section 831 that corresponds generally to the location of the cushioning element 820 and is able to deform at least somewhat independently from the remaining portion of the outsole 830.

Figure 11:
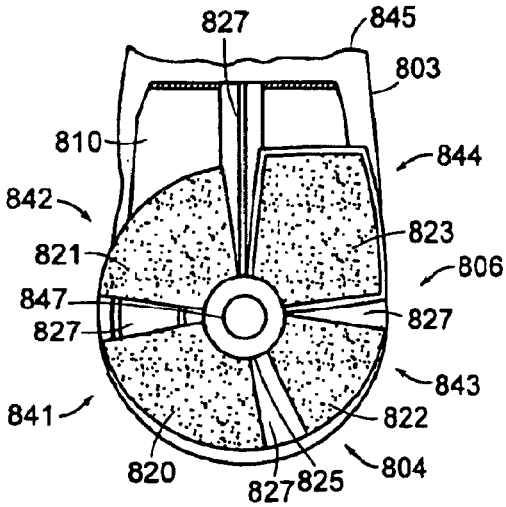
FIG. 11 is a schematic cross-sectional view of a heel region of the shoe of FIG. 8 taken along line 11—11.

FIG. 11 depicts a cross-sectional view of the heel region 806 and second cartridge cushioning system 807 taken along line 11—11 in FIG. 8. The heel region 806 is generally divided into four quadrants that correspond to specific regions of the heel. The four quadrants are the lateral rear portion 841, the lateral forward portion 842, the medial rear portion 843, and the medial forward portion 844. In this embodiment, four functional elements are generally disposed in the four quadrants of a generally circular area of the heel region 806. The cushioning element 820 is disposed substantially within the lateral rear quadrant 841. The first guidance element 821 is disposed substantially within the lateral forward quadrant 842 and the second guidance element 822 is disposed substantially within the medial rear quadrant 843. An optional stability element 823 is disposed substantially within the medial forward quadrant 844 and, in the embodiment shown, extends furthest into a midfoot portion 845 of the sole 803. In one embodiment, the stability element 823 can laterally extend beyond an edge of the second load distribution plate 810 to better avoid excessive pronation.

Figure 12:
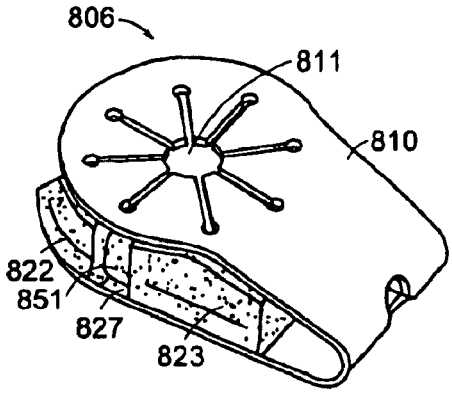
FIG. 12 is a partial schematic perspective view of an alternative embodiment of the heel cartridge cushioning system of FIG. 11.

In one embodiment, as shown in FIG. 12, the second load distribution plate 810 has a U-shaped bend in the front area and receives in an interior region thereof the functional elements, for example, the stability element 823 and the second guidance element 822. The second load distribution plate 810 can function as a structural element, with the functional elements 820, 821, 822, 823 inserted into its interior. The second cartridge cushioning system 807 can supply the structure and stability necessary for a long lifetime of use.

As can be seen in FIGS. 8, 11, and 12, the functional elements 820, 821, 822, 823 are spaced apart, thereby forming gaps 827 between the cushioning element 820, the guidance elements 821, 822, and the stability element 823. In one embodiment and as shown in FIG. 12, additional reinforcing elements 851 can be inserted into these gaps 827. The additional reinforcing elements can be used, for example, if the shoe 801 will be subjected to particularly high loads. A further, highly viscous cushioning element 847 can, if desired, be inserted into a generally circular recess 825 in the center of the second load distribution plate 810 to provide additional cushioning directly below the calcaneus bone of the foot, if desired.

As shown in FIG. 12, the second load distribution plate 810 may include a star-like opening 811 disposed through the top portion of the plate 810. The opening 811 helps to assure uniform pressure distribution to the heel of the athlete. In addition to the star-like shape, the opening 811 may be other shapes that facilitate breathability and the anchoring of the functional elements 820, 821, 822, 823 within or below the second load distribution plate 810. Further, the second load distribution plate may include ridges as described with respect to the first cartridge cushioning system 4 to avoid transverse sliding of the elements 820, 821, 822, 823.

The effect obtained in the heel region 806 and the forefoot region 805 by the combination of the first load distribution plate 800 and the second load distribution plate 810, with the aforementioned functional elements 809, 811, 812, 813, 814, 820, 821, 822, 823, is described with reference to FIGS. 13A to 13D. The arrows depict the forces arising during the different stages of the gait cycle, i.e., from the first ground contact and transitioning into the rolling-off phase.

Figure 13A:
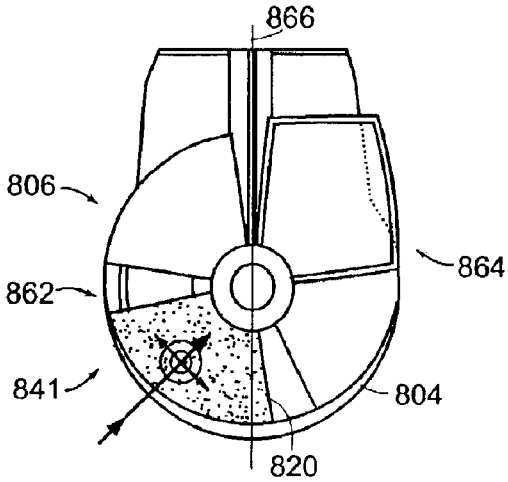
FIGS. 13A–13D are schematic representations of the progression of the lines of forces starting from ground contact until push-off of the shoe shown in FIGS. 8–11.

FIG. 13A depicts the first ground contact, which typically occurs with the major part of the athlete's weight on the lateral rear quadrant 841 of the heel region 806. The cushioning element 820 dissipates the energy transmitted during ground contact to the foot and, thus, protects the joints of the foot and the knee against excessive strains.

Figure 13B:
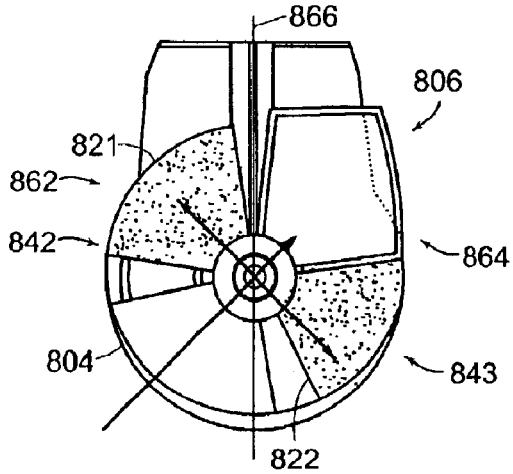

FIG. 13B shows the next step, when the athlete's weight transitions to the lateral front quadrant 842 and the medial rear quadrant 843. The guidance elements 821, 822 are now under load, as shown by the corresponding arrows, and by virtue of the matching material properties, the guidance elements 821, 822 orient the foot. In other words, the guidance elements 821, 822 bring the foot into a substantially parallel orientation with respect to the ground, i.e., a neutral position between supination and pronation. The center of mass of the load is shifted from its original position at the lateral rear quadrant 841 to the center of the heel region 806. This function of the guidance elements 821, 822 can be achieved by suitable material properties, in particular the compressibility of the elements 821, 822.

Figure 13C:
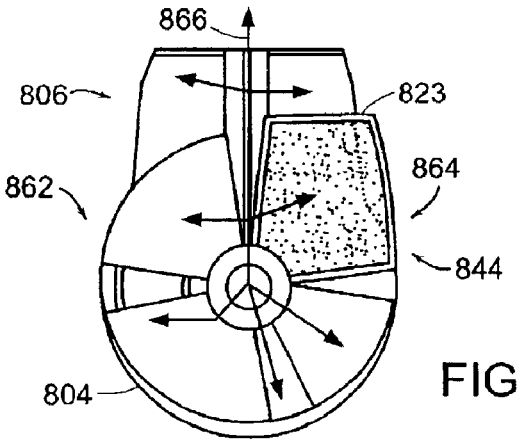

FIG. 13C shows the last stage of the ground-contacting phase just prior to the transition to the rolling-off with the forefoot portion of the sole 803. The optional stability element 823 stops the shift of the position of the center of mass from the lateral side 862 to the medial side 864 and helps to prevent excessive pronation. This is depicted in FIG. 13C by the arrows, which represent the redirecting of the force line along a longitudinal axis 866 of the shoe 801 so that the overall load is substantially evenly distributed between the medial side 864 and the lateral side 862 of the sole 803. Thus, the ground-contacting sequence schematically illustrated in FIGS. 13A–13C assures that the wearer's foot is oriented for a correct course of motion by the time the ground-contacting phase with the heel is terminated.

Figure 13D:
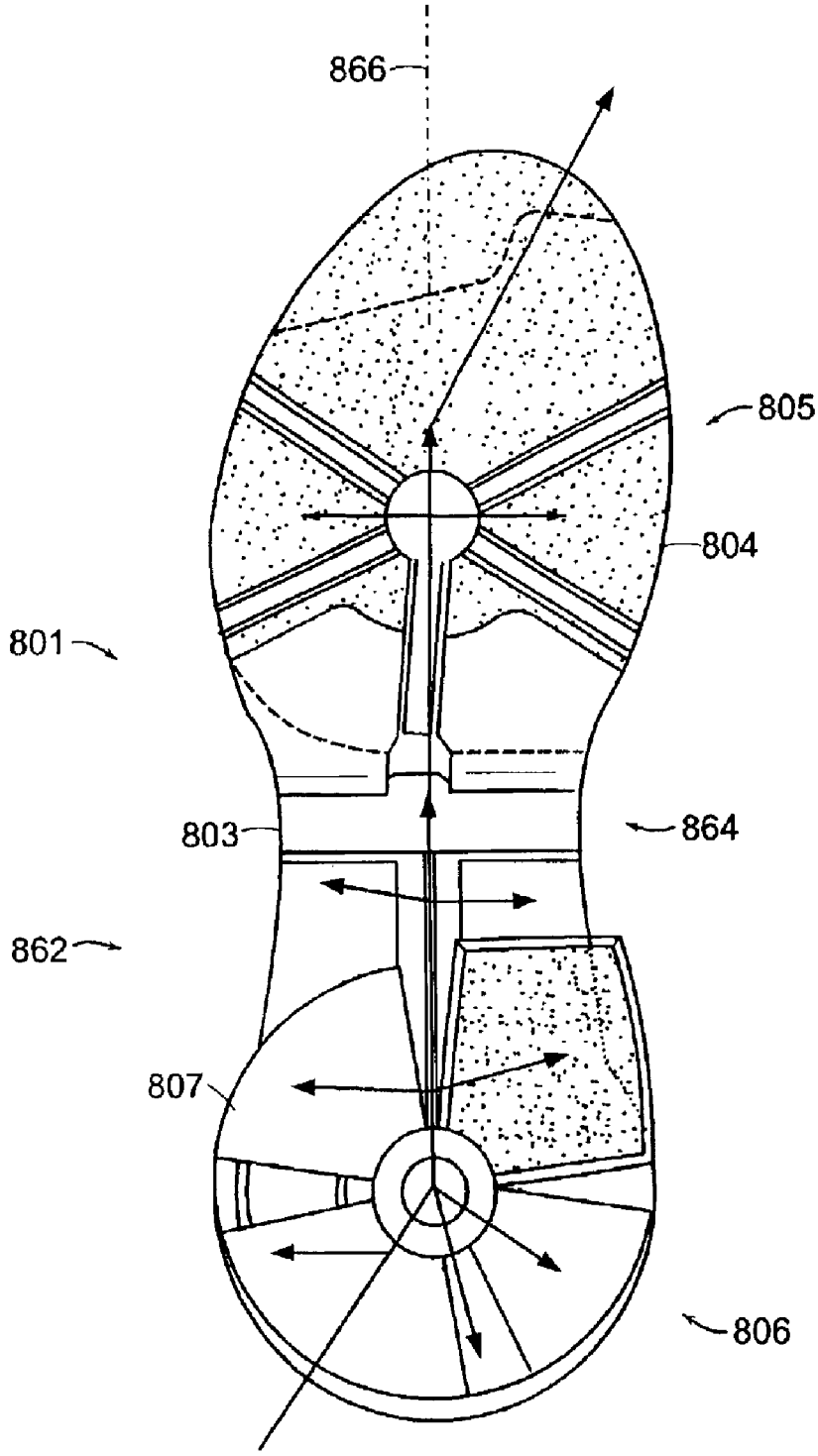

FIG. 13D shows the force line during rolling-off and during push-off. At first, the straight movement of the center of gravity parallel to the longitudinal axis 866 of the shoe 801 is continued and the load evenly distributed on the lateral side 862 and the medial side 864 of the forefoot region 805, so that the foot maintains a neutral position. In the foremost region, the force line slightly skews to the medial side 864 in the direction of the great toe, which bears the greatest load during push-off.

Thus, the sequence schematically depicted in FIGS. 13A to 13D assures that the foot is, at the time when the ground-contacting phase with the heel is terminated, oriented for a correct course of motion. The second load distribution plate 810 transmits the cushioning, guiding, and stability functions of the elements 820, 821, 822, 823 to the complete area of the heel, thereby providing the intended effect on the orientation of the foot. The first load distribution plate 800 and the deformation elements 809, 811, 812, 813, arranged below continue the selective control of the course of motion, until finally the toe-deformation element 114 supports push-off due to its particular elasticity.

The functional elements 820, 821, 822, 823, as well as the deformation elements 110, 111, 112, 113, 114, may be advantageously manufactured from foamed elements, for example, a polyurethane (PU) foam based on a polyether. As described above, foamed EVA can also be used. The use of a PU foam based on a polyether is particularly advantageous in the heel region 806, while rubber based EVA foams are advantageously used in the forefoot region 5, due to their higher elasticity. Other suitable materials will be apparent to those of skill in the art.

The desired element function, for example cushioning, guiding, or stability, can be obtained by varying the compressibility of the functional elements 820, 821, 822, 823. In one embodiment, the hardness values of the functional elements 820, 821, 822, 823 are in the range of about 35–90 Shore Asker C (ASTM 790), more preferably in the range of about 55–70 Shore Asker C. The relative differences between cushioning, guidance, and stability depend on the field of use of the shoe and the size and the weight of the athlete. In one embodiment, the hardness of the cushioning element 20 is about Shore 60 C and the hardness of the guidance elements 21, 22 and the stability element 23 is about Shore 65 C. Different hardnesses or compressibilities can be obtained by, for example, different densities of the aforementioned foams. In one embodiment, the density of the first guidance element 21 and/or the second 22 guidance element, and/or the stability element 23 is not uniform, but varies, such as by increasing from a rear portion of the element to a front portion of the element. In this embodiment, the compressibility decreases in this direction.

The size and shape of the functional elements 820, 821, 822, 823, as well as the deformation elements 110, 111, 112, 113, 114, may vary to suit a particular application. The elements can have essentially any shape, such as polygonal, arcuate, or combinations thereof. In the present application, the term polygonal is used to denote any shape including at least two line segments, such as rectangles, trapezoids, and triangles, and portions thereof. Examples of arcuate shapes include circles, ellipses, and portions thereof.

The load distribution plates 100, 810 can be manufactured from lightweight stable plastic materials, for example, thermoplastic polyester elastomers, such as the Hytrel® brand sold by Dupont. Alternatively, a composite material of carbon fibers embedded into a matrix of resin can be used. Other suitable materials include glass fibers or para-aramid fibers, such as the Kevlar® brand sold by Dupont and thermoplastic polyether block amides, such as the Pebax® brand sold by Elf Atochem. In a particular embodiment, Pebax® 7233 is used. The load distribution plates 100, 810 should have sufficient stiffness to distribute the loads transmitted by the separate elements to a large area and should be sufficiently tough to withstand continuous and cyclical loads for a long lifetime. Accordingly, other suitable materials will be apparent to those of skill in the art. In one embodiment, the load distribution plates 100, 810 have a hardness of about Shore 72 D. The size, shape, and composition of the load distribution plates 100, 810 may vary to suit a particular application.

The load distribution plates 100, 810 and the elements 110, 111, 112, 113, 114, 820, 821, 822, 823 can be manufactured, for example, by molding or extrusion. Extrusion processes may be used to provide a uniform shape. Insert molding can then be used to provide the desired geometry of open spaces, or the open spaces could be created in the desired locations by a subsequent machining operation. Other manufacturing techniques include melting or bonding. For example, the elements 110, 111, 112, 113, 114, 820, 821, 822, 823 may be bonded to the load distribution plates 100, 810 with a liquid epoxy or a hot melt adhesive, such as EVA. In addition to adhesive bonding, portions can be solvent bonded, which entails using a solvent to facilitate fusing of the portions to be added.

Figure 14:
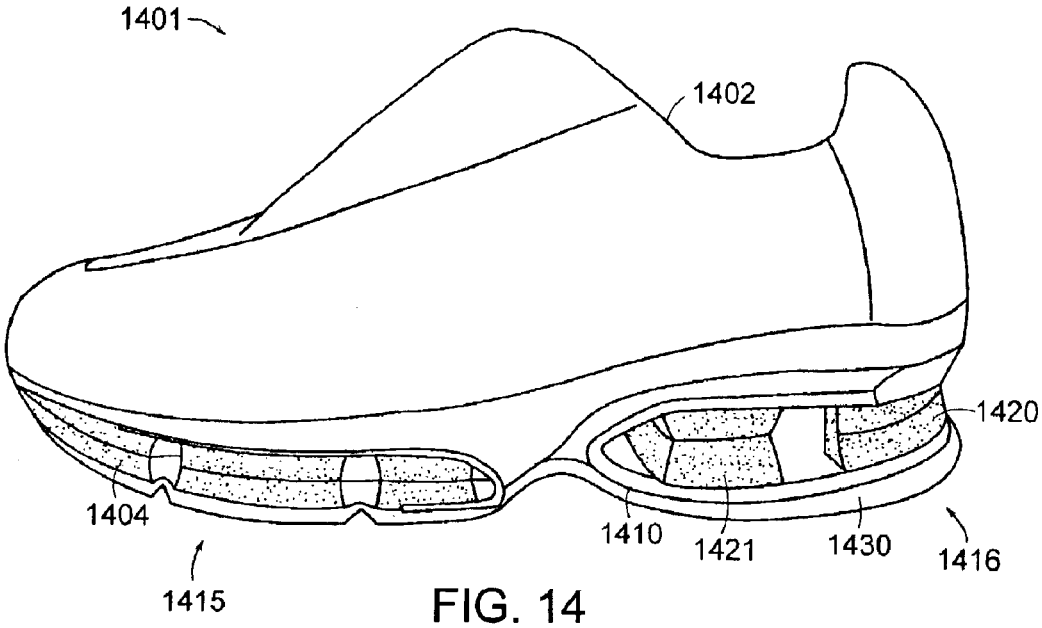
FIG. 14 is a schematic side view of a shoe with an alternative embodiment of a sole in accordance with the invention.

Whereas the shoe shown in FIG. 8 contains an embodiment of a sole in accordance with the invention for a running shoe 801, FIG. 14 shows an alternative embodiment for a basketball shoe 1401. The overall shoe construction, for example the upper 1402 and the first cartridge cushioning system 1404, may be similar to that discussed hereinabove. As shown in FIG. 14, the lower part of the U-shaped encasement of the second load distribution plate 1410 is extended to the rear in order to obtain an even greater stability of the heel region 1416. Further, the second load distribution plate 1410 has, in the embodiment shown in FIG. 14, a smaller radius of curvature in its U-shaped section to allow a more distinct support of the arch of the foot in the adjacent forefoot region 1415. The design of the outsole 1430 is essentially the same as the outsole 830 shown in FIG. 10. For example, a separate section corresponds to a cushioning element 1420 to facilitate independent deformation.

Figure 15:
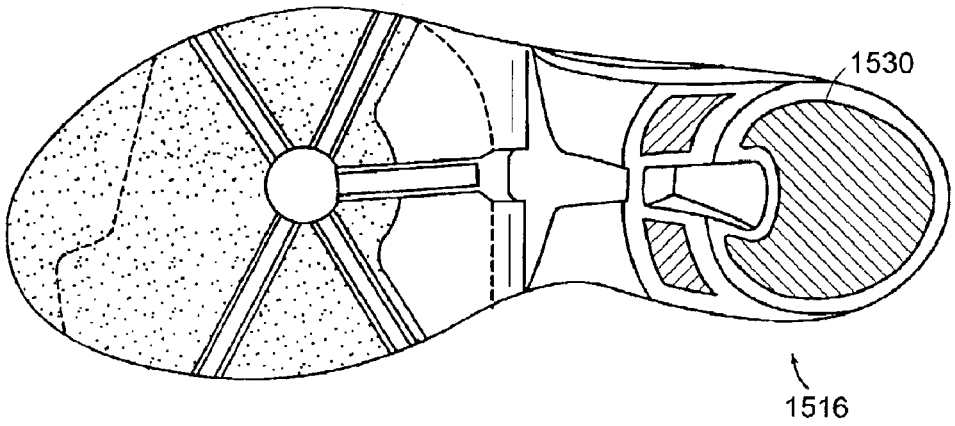
FIG. 15 is a schematic bottom view of the sole of FIG. 14.

FIG. 15 depicts an alternative embodiment of a continuous outsole 1530 in the heel region 1516, that is advantageously used in a shoe subject to particularly high peak loads, for example the basketball shoe of FIG. 14. Alternatively, the outsole 1530 may be designed similarly to the outsole 200 discussed with respect to FIG. 3. The outsole 1530 may bridge the distances between the separate elements with bellows-like structures to assure independent deformation of the elements and to avoid simultaneously the penetration of dirt or moisture.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A sole for an article of footwear, the sole comprising:

a first load distribution plate disposed in a forefoot region of the sole;

a first guidance element disposed in an aft end of the forefoot region adapted to maintain a wearer's foot in a neutral position during a foot's transition to a rolling-off phase of a step cycle after ground contact;

an elastic deformation element disposed in a forward end of the forefoot region adapted to facilitate a push-off from the ground at the end of the rolling-off phase of the step cycle; and wherein the first load distribution plate extends from the aft end of the forefoot region to encase at least partially at least one of the first guidance element and the elastic deformation element, the first guidance element having a greater hardness than the elastic deformation element.

2. The sole of claim 1, wherein the first guidance element and the elastic deformation element are spaced apart from each other to independently deform in response to a load on the sole.

3. The sole of claim 1, wherein the first load distribution plate has a generally recumbent U-shaped cross-sectional profile, wherein a closed end of the load distribution plate is oriented towards the aft end of the forefoot region of the sole.

4. The sole of claim 3, wherein the first load distribution plate comprises a lateral lower side and a medial lower side, wherein each lower side can be independently deflected.

5. The sole of claim 4, wherein the lateral lower side and the medial lower side are separated from each other.

6. The sole of claim 4, wherein the first load distribution plate comprises an upper side extending further towards a front portion of the sole than at least one of the lateral lower side and the medial lower side.

7. The sole of claim 1, wherein the first guidance element comprises a lateral rear deformation element and a medial rear deformation element and the elastic deformation element comprises a lateral front deformation element and a medial front deformation element.

8. The sole of claim 7, wherein the lateral rear deformation element, the lateral front deformation element, the medial rear deformation element, and the medial front deformation element are spaced apart from each other.

9. The sole of claim 8, further comprising a toe-deformation element disposed in a forward portion of the forefoot region and spaced apart from the lateral front deformation element and the medial front deformation element.

10. The sole of claim 9, wherein the toe-deformation element extends beyond a forward edge of the first load distribution plate.

11. The sole of claim 9, wherein the toe-deformation element is more elastic than at least one of the lateral rear deformation element and the medial rear deformation element.

12. The sole of claim 9, wherein the lateral rear deformation element, the lateral front deformation element, the medial rear deformation element, the medial front deformation element, and the toe-deformation element are substantially uniformly spaced apart.

13. The sole of claim 12, further comprising at least one ridge in the load distribution plate disposed between adjacent deformation elements.

14. The sole of claim 9, wherein elasticity of at least one of the deformation elements varies within the at least one of the deformation elements.

15. The sole of claim 7, wherein at least one of the lateral deformation elements has a different hardness than at least one of the medial deformation elements.

16. The sole of claim 1 further comprising:

a second load distribution plate disposed in a heel region of the sole;

at least one cushioning element disposed proximate the second load distribution plate to cushion the sole during a first ground contact with the heel region; and a second guidance element disposed proximate the second load distribution plate for bringing the wearer's foot toward the neutral position after the first ground contact, wherein the second guidance element has a greater hardness than the at least one cushioning element.

17. The sole of claim 16, further comprising a stability element disposed proximate the second load distribution plate, the stability element adapted to control pronation during transition to the rolling-off phase of the step cycle.

18. The sole of claim 17, wherein the second guidance element comprises a lateral guidance element and a medial guidance element.

19. The sole of claim 18, wherein the cushioning element, the lateral guidance element, the medial guidance element, and the stability element are each disposed generally within quadrants of the heel region.

20. The sole of claim 19, wherein the cushioning element is generally located in a lateral rear quadrant, the lateral guidance element is generally located in a lateral forward quadrant, the medial guidance element is generally located in a medial rear quadrant, and the stability element is generally located in a medial forward quadrant.

21. The sole of claim 20, wherein at least two of the cushioning element, the lateral guidance element, the medial guidance element, and the stability element are spaced apart.

22. The sole of claim 21 further comprising at least one reinforcing element disposed between adjacent elements.

23. The sole of claim 18, wherein at least one of the lateral guidance element and the medial guidance element has a greater hardness than the cushioning element.

24. The sole of claim 18, wherein the hardness of at least one of the lateral guidance element, the medial guidance element, and the stability element varies within the at least one of the lateral guidance element, the medial guidance element, and the stability element.

25. The sole of claim 18, wherein the stability element extends beyond an edge of the second load distribution plate.

26. The sole of claim 18, wherein the second load distribution plate has a generally recumbent U-shaped cross-sectional profile and receives in an interior region thereof at least a portion of one of the cushioning element, the lateral guidance element, the medial guidance element, and the stability element.

27. The sole of claim 26, wherein a closed end of the second load distribution plate is oriented towards the forefoot region of the sole.

28. The sole of claim 18, further comprising an outsole at least partially disposed below at least one of the cushioning element, the lateral guidance element, the medial guidance element, the stability element, the first guidance element, and the elastic deformation element.

29. The sole of claim 28, wherein the outsole is adapted to allow for independent deformation of at least one of the cushioning element, the lateral guidance element, the medial guidance element, the stability element, the first guidance element, and the elastic deformation element.

30. The sole of claim 16, wherein the first load distribution plate is coupled to the second load distribution plate.

31. An article of footwear comprising an upper and a sole, the sole comprising:

a first load distribution plate disposed in a forefoot region of the sole;

a guidance element disposed in an aft end of the forefoot region adapted to maintain a wearer's foot in a neutral position during a foot's transition to a rolling-off phase of a step cycle after ground contact;

an elastic deformation element disposed in a forward end of the forefoot region adapted to facilitate a push-off from the ground at the end of the rolling-off phase of the step cycle; and wherein the first load distribution plate extends from the aft end of the forefoot region to encase at least partially at least one of the guidance element and the elastic deformation element, the guidance element having a greater hardness than the elastic deformation element.

32. A sole for an article of footwear, the sole comprising:

a lateral deformation element;

a medial deformation element; and a first load distribution plate disposed in a forefoot region of the sole, the first load distribution plate comprising:

a generally recumbent U-shaped cross-sectional profile;

a lateral lower side and a medial lower side, wherein each lower side can be independently deflected; and wherein the first load distribution plate extends from an-aft end of the forefoot region to encase at least partially at least one of the lateral deformation element and the medial deformation element and wherein a closed end of the load distribution plate is oriented towards the aft end of the forefoot region of the sole.

33. The sole of claim 32, wherein the lateral lower side and the medial lower side are separated from each other.

34. The sole of claim 32, wherein the first load distribution plate comprises an upper side extending further towards a front portion of the sole than at least one of the lateral lower side and the medial lower side.

* * * * *